US007190919B2

(12) United States Patent
Kitagawa

(10) Patent No.: US 7,190,919 B2
(45) Date of Patent: Mar. 13, 2007

(54) INTERMEDIATE TRANSFER DEVICE AND IMAGE FORMING DEVICE

(75) Inventor: Yusuke Kitagawa, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 167 days.

(21) Appl. No.: 11/007,226

(22) Filed: Dec. 9, 2004

(65) Prior Publication Data

US 2005/0254852 A1 Nov. 17, 2005

(30) Foreign Application Priority Data

May 17, 2004 (JP) ..... 2004-146484

(51) Int. Cl.
*G03G 15/16* (2006.01)
*G03G 15/01* (2006.01)
*G03G 15/20* (2006.01)

(52) U.S. Cl. ..... 399/101; 399/302; 399/308

(58) Field of Classification Search ..... 399/101, 399/99, 98, 91, 121, 130, 297, 298, 302, 399/308, 347, 349, 129
See application file for complete search history.

(56) References Cited

U.S. PATENT DOCUMENTS 4,739,370 A * 4/1988 Yoshida et al. ..... 399/347
4,972,233 A * 11/1990 Yamazaki et al. ..... 399/347
5,667,926 A * 9/1997 Maruyama et al. ..... 430/97
5,722,015 A * 2/1998 Tombs ..... 399/129
5,907,746 A * 5/1999 Kubota ..... 399/101
6,311,037 B1 * 10/2001 Hisakuni et al. ..... 399/350
6,980,761 B2 * 12/2005 Yamada ..... 399/302
7,039,353 B2 * 5/2006 Yamada et al. ..... 399/349
2004/0213598 A1 * 10/2004 Mori et al. ..... 399/101

FOREIGN PATENT DOCUMENTS

JP 2003-98839 A 4/2003

* cited by examiner

*Primary Examiner*—Andrew H. Hirshfeld
*Assistant Examiner*—Hoai-An D. Nguyen
(74) *Attorney, Agent, or Firm*—Sughrue Mion, PLLC

(57) ABSTRACT

An intermediate transfer device has: an intermediate transfer belt supported by a plurality of belt supporting mechanisms so as to be able to circulate, and having elasticity at least in a direction of circulating; a first bias applying mechanism applying a first bias voltage to toner on a toner carrier surface of the intermediate transfer belt; a layer thinning mechanism contacting the toner carrier surface and electrostatically attracting the toner which is on the toner carrier surface so as to thin a layer of the toner; a second bias applying mechanism applying a second bias voltage to the toner whose layer has been thinned; an image carrier carrying a visible image to be transferred onto the toner carrier surface, the toner on the toner carrier surface, to which the second bias voltage has been applied, being transferred onto the image carrier; and a toner removing mechanism removing the toner on the image carrier.

14 Claims, 10 Drawing Sheets

INTERMEDIATE TRANSFER DEVICE AND IMAGE FORMING DEVICE

CROSS-REFERENCE TO RELATED APPLICATION

This application claims priority under 35 USC 119 from Japanese Patent Application No. 2004-146484, the disclosure of which is incorporated by reference herein.

BACKGROUND OF THE INVENTION

1. Field of the Invention

The present invention relates to an intermediate transfer device and an image forming device.

2. Description of the Related Art

In an image forming device in which a toner image is first transferred (primary transfer) to an intermediate transfer belt and then this toner image is transferred (secondary transfer) to a recording medium such as a sheet or the like, the toner remaining on the toner carrier surface of the intermediate transfer belt ("toner remaining after transfer") must be removed.

Generally, a member which does not have elasticity in the direction in which it is stretched is used as the intermediate transfer belt. However, in recent years, structures have been proposed which can improve image quality by using an elastic intermediate transfer belt and improving the close contact between the intermediate transfer belt and a photosensitive body, or the like.

For example, Japanese Patent Application Laid-Open (JP-A) No. 2003-98839 discloses a cleaning device using an intermediate transfer belt which is elastic. A cleaning roller is made to contact this elastic intermediate transfer belt so as to clean the toner carrier surface.

In order to reliably clean the toner carrier surface of the intermediate transfer belt, it is preferable to make the cleaning roller strongly contact the intermediate transfer belt. However, when the intermediate transfer belt which is elastic is strongly pushed, there are problems such as elongation arises at the intermediate transfer belt, and the like.

SUMMARY OF THE INVENTION

In view of the aforementioned, an object of the present invention is to provide an intermediate transfer device which can reliably remove toner remaining after transfer while reducing mechanical stresses on an intermediate transfer belt and keeping elongation of the belt low, and to provide an image forming device equipped with such an intermediate transfer belt.

A first aspect of the present invention provides an intermediate transfer device comprising: an intermediate transfer belt formed in an endless shape, and supported by a plurality of belt supporting mechanisms so as to be able to circulate, and having elasticity at least in a direction of circulating; and a plurality of cleaning members disposed so as to contact the intermediate transfer belt.

In this intermediate transfer device, the intermediate transfer belt is supported by the plurality of belt supporting mechanisms so as to be able to circulate, and the plurality of cleaning members are disposed so as to contact the intermediate transfer belt. Accordingly, as compared with a structure in which only one cleaning member is provided, the intermediate transfer belt can be reliably cleaned even if the contact pressure of each cleaning member with respect to the intermediate transfer belt is low. In particular, even if the intermediate transfer belt is an intermediate transfer belt which is elastic in the direction of circulating, elongation due to contact with the cleaning members can be made to be small.

A second aspect of the present invention provides an intermediate transfer device comprising: an intermediate transfer belt formed in an endless shape, and supported by a plurality of belt supporting mechanisms so as to be able to circulate, and having elasticity at least in a direction of circulating; a layer thinning mechanism contacting a toner carrier surface of the intermediate transfer belt, and electrostatically attracting toner which is on the toner carrier surface so as to thin a layer of the toner; a bias applying mechanism provided at a downstream side, in the direction of circulating of the intermediate transfer belt, of the layer thinning mechanism, and applying bias voltage to the toner on the toner carrier surface whose layer has been thinned; an image carrier provided at a downstream side, in the direction of circulating of the intermediate transfer belt, of the bias applying mechanism, and carrying a visible image to be transferred onto the toner carrier surface, the toner on the toner carrier surface, to which bias voltage has been applied by the bias applying mechanism, being transferred onto the image carrier; and a toner removing mechanism removing the toner on the image carrier.

In this intermediate transfer device, the layer of the toner on the toner carrier surface of the intermediate transfer belt is first thinned by the layer thinning mechanism (i.e., a portion of the toner is removed). Then, bias voltage is applied by the bias applying mechanism to the toner whose layer has been thinned. Because the layer of the toner has been thinned, the bias voltage can be applied sufficiently throughout all of the toner (or even to the deepest region of the toner).

This toner is transferred from the toner carrier surface onto the image carrier, which carries a visible image to be transferred onto the toner carrier surface. Because the bias voltage is applied sufficiently throughout all of the toner (or even to the deepest region of the toner), the toner can be reliably attracted by and transferred onto the image carrier. Further, the toner on the image carrier is removed by the toner removing mechanism.

In this way, the toner on the toner carrier surface is removed at two stages at the layer thinning mechanism and the image carrier. Therefore, even if the contact pressure of each with respect to the intermediate transfer belt is low, the intermediate transfer belt can be cleaned reliably. In particular, even if the intermediate transfer belt is an intermediate transfer belt which is elastic in the direction of circulating, elongation due to contact of the cleaning members can be made to be small.

A third aspect of the present invention provides an intermediate transfer device comprising: an intermediate transfer belt formed in an endless shape, and supported by a plurality of belt supporting mechanisms so as to be able to circulate, and having elasticity at least in a direction of circulating; a first bias applying mechanism applying a first bias voltage to toner on a toner carrier surface of the intermediate transfer belt, so as to control an amount of charge of the toner; a layer thinning mechanism provided at a downstream side, in the direction of circulating of the intermediate transfer belt, of the first bias applying mechanism, and contacting the toner carrier surface and electrostatically attracting the toner which is on the toner carrier surface so as to thin a layer of the toner; a second bias applying mechanism provided at a downstream side, in the direction of circulating of the intermediate transfer belt, of the layer thinning mechanism, and applying a second bias voltage to the toner whose layer has been thinned, so as to control an amount of charge of the toner; an image carrier provided at a downstream side, in the direction of circulating of the intermediate transfer belt, of the second bias applying mechanism, and carrying a visible image to be transferred onto the toner carrier surface, the toner on the toner carrier surface, to which the second bias voltage has been applied, being transferred onto the image carrier; and a toner removing mechanism removing the toner on the image carrier.

In this intermediate transfer device, first, the first bias voltage is applied by the first bias applying mechanism to the toner on the toner carrier surface of the intermediate transfer belt, such that the amount of charge of the toner is controlled. Then, the toner is electrostatically attracted by the layer thinning mechanism such that the layer of the toner is thinned.

The second bias voltage is applied by the second bias applying mechanism to this toner, such that the amount of charge of the toner is controlled. In this state, because the layer of the toner has been thinned, the second bias voltage can be applied sufficiently throughout all of the toner (or even to the deepest region of the toner).

This toner is transferred from the toner carrier surface onto the image carrier, which carries a visible image to be transferred onto the toner carrier surface. Because the bias voltage is applied sufficiently throughout all of the toner (or even to the deepest region of the toner), the toner can be reliably attracted by and transferred onto the image carrier. Further, the toner on the image carrier is removed by the toner removing mechanism.

In this way, the toner on the toner carrier surface is removed at two stages at the layer thinning mechanism and the image carrier. Therefore, even if the contact pressure of each with respect to the intermediate transfer belt is low, the intermediate transfer belt can be cleaned reliably. In particular, even if the intermediate transfer belt is an intermediate transfer belt which is elastic in the direction of circulating, elongation due to contact of the cleaning members can be made to be small.

There are two mechanisms which apply bias voltage to the toner on the toner carrier surface, i.e., the first bias applying mechanism and the second bias applying mechanism. Therefore, even if the contact pressure of each with respect to the intermediate transfer belt is low, elongation of the intermediate transfer belt can be made to be small.

A fourth aspect of the present invention provides an image forming device comprising: the intermediate transfer device of the present invention; a primary transfer section primarily transferring a toner image to the intermediate transfer device; and a secondary transfer section secondarily transferring the toner image of the intermediate transfer device onto a recording medium.

In this image forming device, an image is primarily transferred from the primary transfer section to the intermediate transfer device, and then the image is secondarily transferred by the secondary transfer section onto a recording medium, and the desired image is formed on the recording medium. Because the image forming device has the intermediate transfer device of the present invention, toner remaining after transfer can be reliably removed while elongation of the intermediate transfer belt, which is elastic in the direction of circulating, is kept low.

DETAILED DESCRIPTION OF THE INVENTION

Hereinafter, a color printer utilizing an electrophotographic process will be described with reference to the drawings as an example of applying the intermediate transfer device and the image forming device relating to the present invention. The image forming device to which the present invention is applied is not limited to the color printer which will be described hereinafter, and may be an image forming device such as a copier, a fax machine, a multifunction device, or the like.

An embodiment of the present invention will be described on the basis of the drawings. In the following explanation, detailed description of structures which are not directly related to the fundamentals of the present invention will be omitted.

Figure 1:
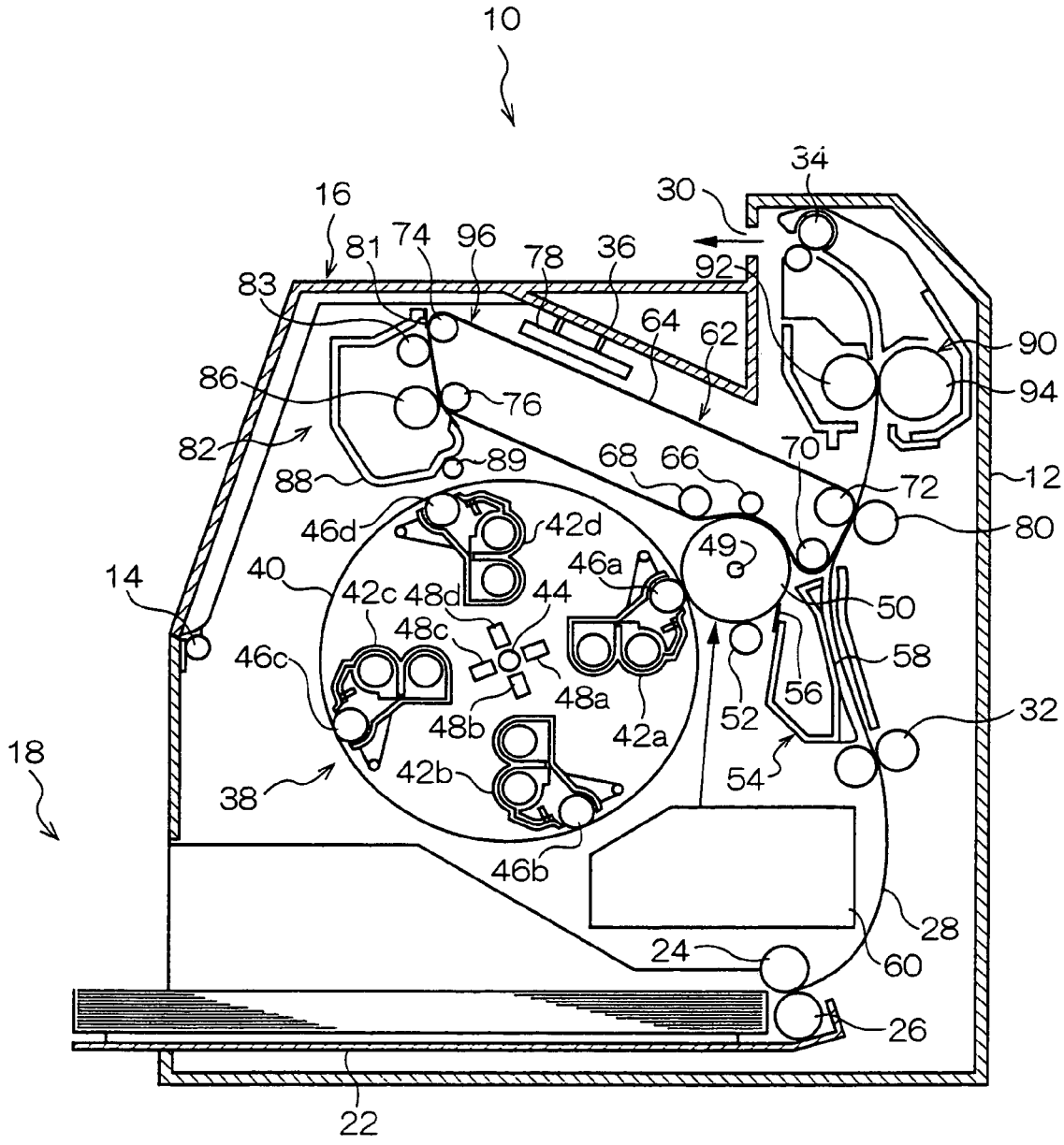
FIG. 1 is a sectional view schematically illustrating an intermediate transfer device relating to an embodiment of the present invention, and the interior of a color printer using the intermediate transfer device.

FIG. 1 shows an overview of an intermediate transfer device 62 (details of which will be described later) relating to an embodiment of the present invention, and of a color printer 10 in which the intermediate transfer device 62 is installed in a color printer main body 12.

The color printer 10 has the color printer main body 12. An opening/closing cover 16, which is freely rotatable around a rotation fulcrum 14, is provided at the upper portion of the color printer main body 12. A sheet feeding unit 18 is disposed at the lower portion of the color printer main body 12.

The sheet feeding unit 18 has a sheet feeding cassette 22 which accommodates recording sheets P. A feed roller 24, which supplies the recording sheets P from the sheet feeding cassette 22, and a retard roller 26, which separates the supplied recording sheets P one-by-one, are disposed in a vicinity above the far rear end of the sheet feeding cassette 22.

A conveying path 28 is a path of the recording sheets P from the feed roller 24 to a discharge opening 30. In a vicinity of the rear side of the color printer main body 12 (the right side in FIG. 1), the conveying path 28 is formed substantially vertically from the sheet feeding unit 18 to a fusing device 90. A secondary transfer roller 80 and a secondary transfer back-up roller 72 are disposed upstream of the fusing device 90 on the conveying path 28. Resist rollers 32 are disposed at the upstream side of the secondary transfer roller 80 and the secondary transfer back-up roller 72. Discharge rollers 34 are disposed at the conveying path 28 in a vicinity of the discharge opening 30.

Accordingly, the recording sheet P, which is fed-out from the sheet feeding cassette 22 of the sheet feeding unit 18 by the feed roller 24, is separated by the retard roller 26 such that only the topmost recording sheet P is guided to the conveying path 28. This recording sheet P is temporarily stopped by the resist rollers 32, and at a given timing, passes through between the secondary transfer roller 80 and an intermediate transfer belt 64 (the secondary transfer back-up roller 72), such that a toner image is transferred onto the recording sheet P. The transferred toner image is fixed by the fusing device 90, and the recording sheet P is discharged out by the discharge rollers 34 from the discharge opening 30 to a discharge section 36 provided at the upper portion of the opening/closing cover 16. The discharge section 36 is inclined such that the portion thereof near the discharge opening is low, and the height thereof gradually becomes greater toward the front (toward the left in FIG. 1).

A rotary developing device 38 is disposed at the substantially central portion of the color printer main body 12. The rotary developing device 38 has, within a developing unit main body 40, developing units 42*a* through 42*d* forming toner images of the four colors of yellow, magenta, cyan, and black, respectively. The developing units 42*a* through 42*d* rotate left (counterclockwise in FIG. 1) around a rotary developing device center 44. The developing units 42*a* through 42*d* respectively have developing rollers 46*a* through 46*d*, and are pressed in directions normal to the developing unit main body 40 by elastic bodies 48*a* through 48*d* such as coil springs or the like.

A photosensitive drum 50, which rotates around a rotation supporting shaft 49, is disposed so as to abut the rotary developing device 38. In the states in which the developing rollers 46*a* through 46*d* are not abutting the photosensitive drum 50, portions of the outer peripheries of the developing rollers 46*a* through 46*d* project out by about 2 mm in the radial direction from the outer periphery of the developing unit main body 40. Tracking rollers (not shown), whose diameters are slightly larger than the diameters of the developing rollers 46*a* through 46*d*, are provided at the both ends of the developing rollers 46*a* through 46*d* respectively, so as to rotate coaxially with the developing rollers 46*a* through 46*d*. Namely, the developing units 42*a* through 42*d* are disposed at the outer periphery of the developing unit main body 40 at intervals of 90° from one another, around the rotary developing device center 44. The tracking rollers of the developing rollers 46*a* through 46*d* abut flanges (not shown) provided at both ends of the photosensitive drum 50 such that latent images on the photosensitive drum are developed by the toners of the respective colors, while a predetermined gap is formed between the developing rollers 46*a* through 46*d* and the photosensitive drum 50.

A charging roller 52 is provided beneath the photosensitive drum 50. A charging bias is applied by the charging roller 52, such that the photosensitive drum 50 is charged uniformly. A cleaner 54 for the photosensitive drum is provided so as to hang downward from the rotation supporting shaft 49 of the photosensitive drum 50. The photosensitive drum 50 and the cleaner 54 for the photosensitive drum are formed integrally. The cleaner 54 for the photosensitive drum is structured from a cleaning blade 56, which scrapes off the waste toner remaining on the photosensitive drum 50 after the primary transfer, and a toner recovery case 58, which recovers the waste toner which has been scraped-off by the cleaning blade 56.

A rib or the like is formed at the rear surface side (the right side in FIG. 1) of the toner recovery case 58, and is formed as a curved surface forming a portion of the conveying path 28 such that the recording sheet P is conveyed smoothly.

An exposure device 60, which writes the latent images by light rays of laser light or the like onto the photosensitive drum which is charged by the charging roller 52, is disposed beneath the rotary developing device 38 at the rear surface side thereof. The intermediate transfer device 62 is provided above the rotary developing device 38. The toner images which are made visible by the rotary developing device 38 are primarily transferred to the intermediate transfer device 62 at a primary transfer position, and the intermediate transfer device 62 conveys the toner image to a secondary transfer position (the nip portion between the secondary transfer roller 80 and the secondary transfer back-up roller 72).

The intermediate transfer device 62 includes the intermediate transfer belt 64, a primary transfer roller 66, a wrap-in roller 68, a wrap-out roller 70, the secondary transfer back-up roller 72, a cleaning back-up roller 74, and a brush back-up roller 76.

The intermediate transfer belt 64 is elastic, and is stretched substantially flat so as to have long sides and short sides above the rotary developing device 38. The two long sides of the intermediate transfer belt 64 are stretched so as to be substantially parallel to the discharge section 36 provided at the top portion of the color printer main body 12.

Between the wrap-in roller 68, which is disposed upstream of the primary transfer roller 66 beneath one long side of the intermediate transfer belt 64, and the wrap-out roller 70, which is disposed downstream of the primary transfer roller 66, the intermediate transfer belt 64 has a primary transfer portion (a photosensitive drum wrapping region) which contacts the photosensitive drum 50 in a wrapping manner. The intermediate transfer belt 64 is trained only around a predetermined range of the photosensitive drum 50, and moves so as to follow the rotation of the photosensitive drum 50.

A transfer power source 67, which applies transfer voltage of the same polarity as the toner on a toner carrier surface 64H of the intermediate transfer belt 64, is connected to the primary transfer roller 66. Accordingly, the toner images on the photosensitive drum 50 are primarily transferred in a superposed manner onto the toner carrier surface 64H (the outer side surface of the belt 64) in the order of yellow, magenta, cyan and black, and the intermediate transfer belt 64 conveys the primarily transferred toner image toward the secondary transfer roller 80. Note that the wrap-in roller 68 and the wrap-out roller 70 are set apart from the photosensitive drum 50.

In this way, the intermediate transfer belt 64 is stretched over five rollers which are the wrap-in roller 68, the wrap-out roller 70, the secondary transfer back-up roller 72, the cleaning back-up roller 74, and the brush back-up roller 76. Further, the toner images on the photosensitive drum 50 are transferred onto the intermediate transfer belt 64 by the primary transfer roller 66. Note that these rollers are formed in hollow-cylindrical shapes or solid-cylindrical shapes in order to stretch and support the intermediate transfer belt 64 such that the intermediate transfer belt 64 can circulate.

Figure 2:
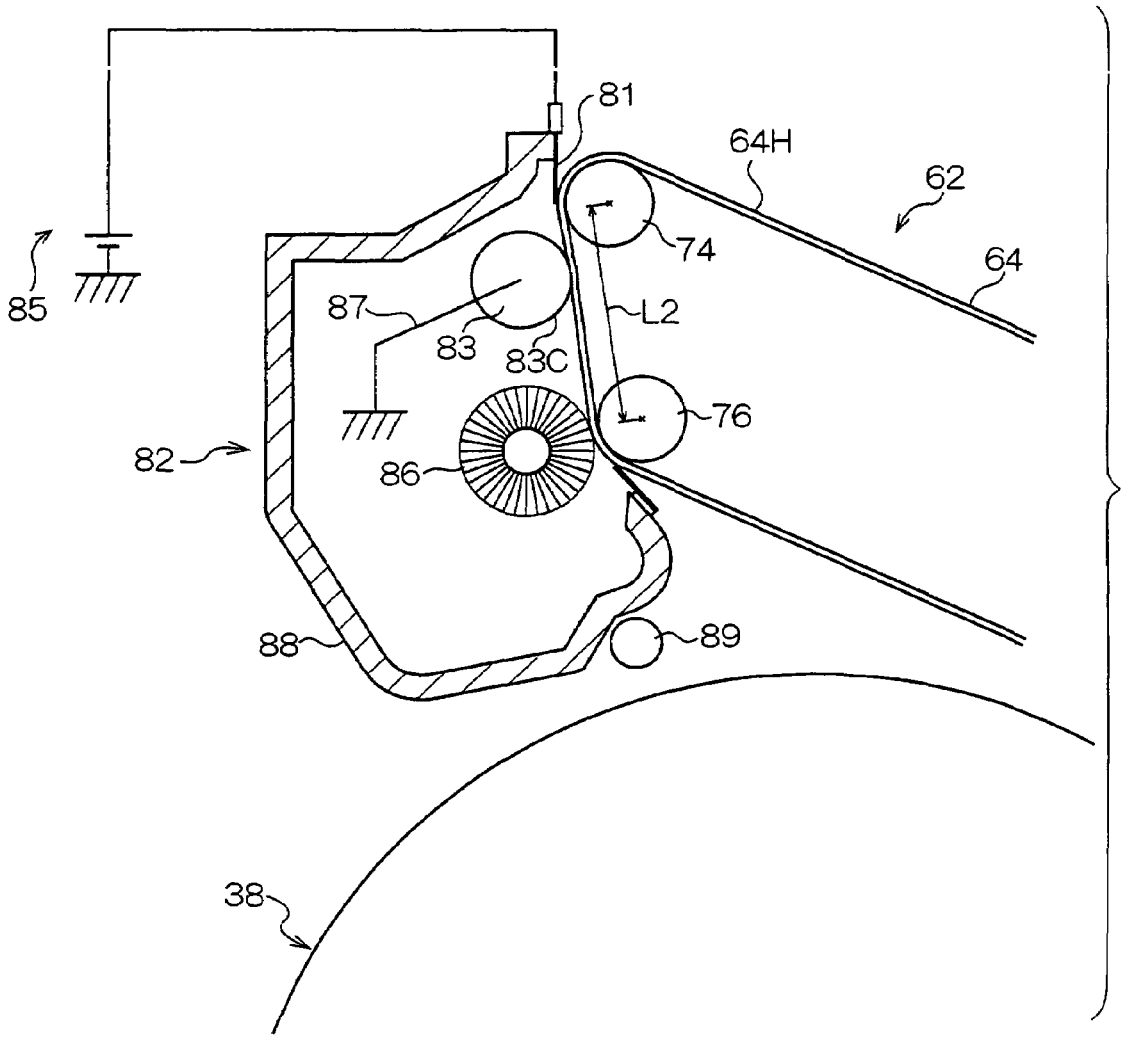
FIG. 2 is an enlarged sectional view showing a vicinity of an intermediate transfer belt cleaner of the intermediate transfer device of the embodiment of the present invention, at a position of contacting an intermediate transfer belt.

As shown in FIG. 2, the cleaning back-up roller 74 and the brush back-up roller 76 are disposed close to one another such that a distance L2 between the rotational centers thereof is shorter than a distance obtained by multiplying the diameter of each of these rollers by two and adding the products together. As described above, this is the short side when the intermediate transfer belt 64 is stretched substantially flat so as to have long sides and short sides. Further, the cleaning back-up roller 74 and the brush back-up roller 76 are disposed such that the distance L2 is shorter than the diameter of the photosensitive drum 50. Therefore, the intermediate transfer device 62 can be made more compact than a structure in which the interval between the cleaning back-up roller 74 and the brush back-up roller 76 is wide.

A flat portion (short side) is formed at the rear side (the right side surface in FIG. 1) of the intermediate transfer belt 64, by the wrap-out roller 70 and the secondary transfer back-up roller 72. This flat portion is the secondary transfer portion, and faces the conveying path 28.

At the secondary transfer portion, the wrap-out roller 70 is disposed such that the region between the intermediate transfer belt 64 and the conveying path 28 is an angle of about 12°.

The cleaning back-up roller 74 assists a cleaning roller 83, which will be described later, in attracting and removing the waste toner which remains on the intermediate transfer belt 64 after the secondary transfer. The brush back-up roller 76 assists a brush roller 86 in scraping off the waste toner which remains on the intermediate transfer belt 64 after the secondary transfer.

A reflection-type photosensor 78 is provided above the long side of the intermediate transfer belt 64, by being fixed to the reverse surface (the inner side) of the opening/closing cover 16. The reflection-type photosensor 78 reads the patches of toner formed on the intermediate transfer belt 64, detects the position of the intermediate transfer belt 64 in the direction of rotation, and senses the density of the toner image.

The secondary transfer roller 80 faces the secondary transfer back-up roller 72 of the intermediate transfer device 62, with the conveying path 28 disposed therebetween. Namely, the region between the secondary transfer roller 80 and the secondary transfer back-up roller 72 is the secondary transfer position at the secondary transfer portion. With the aid of the secondary transfer back-up roller 72, the secondary transfer roller 80 secondarily transfers the toner image, which was primarily transferred onto the intermediate transfer belt 64, onto the recording sheet P at the secondary transfer position. Here, the secondary transfer roller 80 is set apart from the intermediate transfer belt 64 during the time that the intermediate transfer belt 64 rotates three times, i.e., during the time that the toner images of the three colors of yellow, magenta, cyan are primarily transferred onto the intermediate transfer belt in a superposed manner and conveyed. The secondary transfer roller 80 abuts the intermediate transfer belt 64, when the black toner image is transferred thereon.

A predetermined potential difference is made to arise between the secondary transfer roller 80 and the secondary transfer back-up roller 72. When the secondary transfer roller 80 is high voltage, the secondary transfer back-up roller 72 is connected to the ground (GND).

A cleaner 82 for the intermediate transfer belt is provided at the end of the intermediate transfer belt 64 opposite the end at which the photosensitive drum 50 is located. The cleaner 82 for the intermediate transfer belt has an electrically-conductive sheet 81, the cleaning roller 83, the brush roller 86, a toner recovery case 88, and a rotation supporting shaft 89, and can swing around the rotation supporting shaft 89. Due to this swinging, the cleaner 82 for the intermediate transfer belt moves between a contact position (see FIG. 2) at which the electrically-conductive sheet 81, the cleaning roller 83 and the brush roller 86 contact the intermediate transfer belt 64, and a separated position (see FIG. 3) at which these respective members are set apart from the intermediate transfer belt 64.

Figure 4:
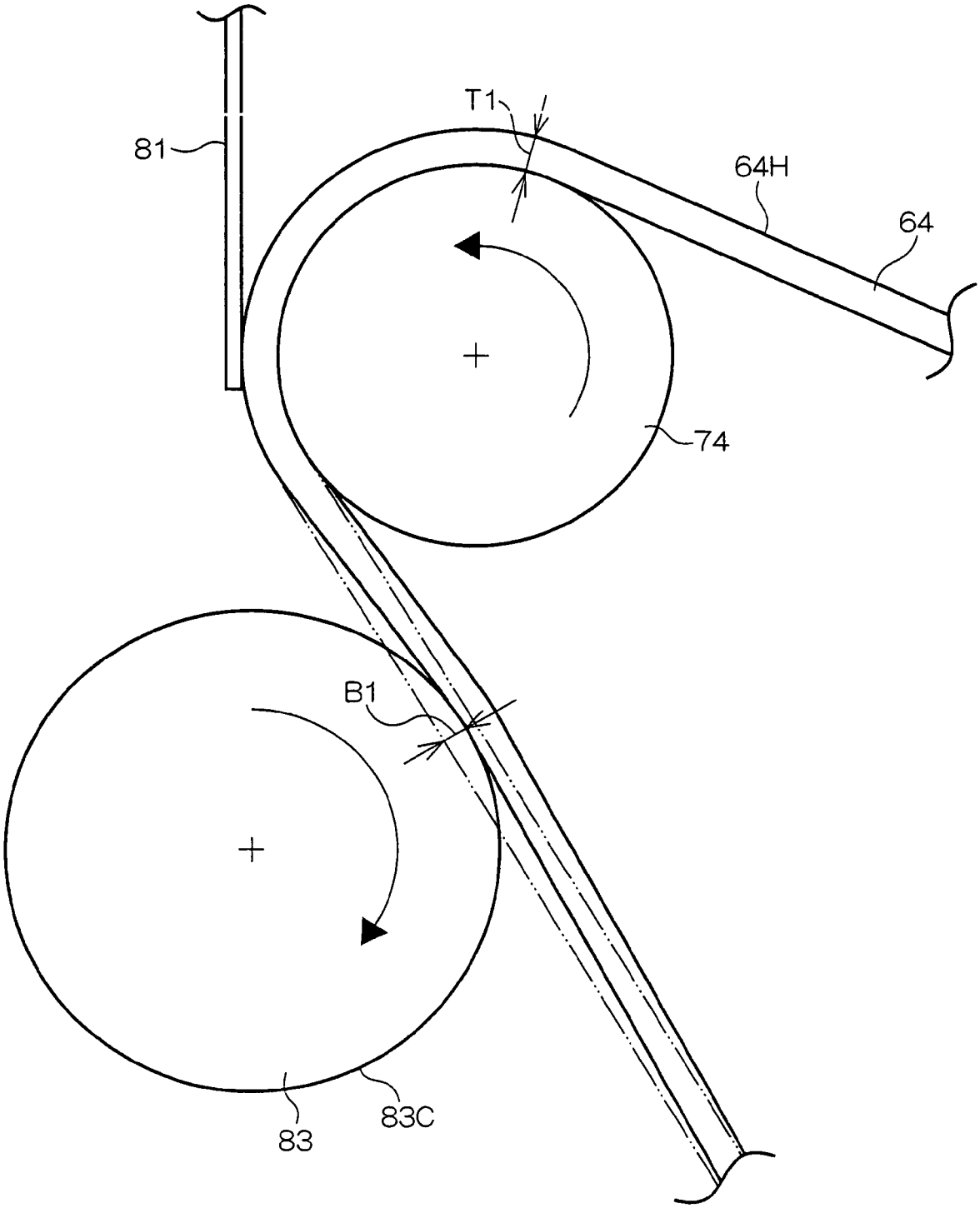
FIG. 4 is an enlarged sectional view showing a vicinity of a cleaning roller of the intermediate transfer device of the embodiment of the present invention, at a position of contacting the intermediate transfer belt.

As shown in FIG. 4, in the present embodiment, a flexed amount B1 of the intermediate transfer belt 64 at the time when the cleaning roller 83 pushes-in the intermediate transfer belt 64 in a state in which the cleaner 82 for the intermediate transfer belt is swung to and reaches the contact position, is smaller than a thickness T1 of the intermediate transfer belt 64 itself. Because the intermediate transfer belt 64 cannot be flexed excessively, the degree of extension/contraction of the intermediate transfer belt 64 can be kept low.

The electrically-conductive sheet 81 is an example of a bias applying mechanism (or first bias applying mechanism) of the present invention, and is structured by a sheet which is elastic and electrically-conductive. One end of the electrically-conductive sheet 81 is fixed to the housing of the intermediate transfer device 62. The other end of the electrically-conductive sheet 81 contacts, along the circulating direction of the intermediate transfer belt 64 and elastically at a predetermined contact pressure, the toner carrier surface 64H of the portion of the intermediate transfer belt 64 trained around the cleaning back-up roller 74. This contact pressure is set such that the electrically-conductive sheet 81 can be made to reliably contact the intermediate transfer belt 64, and such that excess resistance (load) to the circulating of the intermediate transfer belt 64 does not arise.

Figure 5:
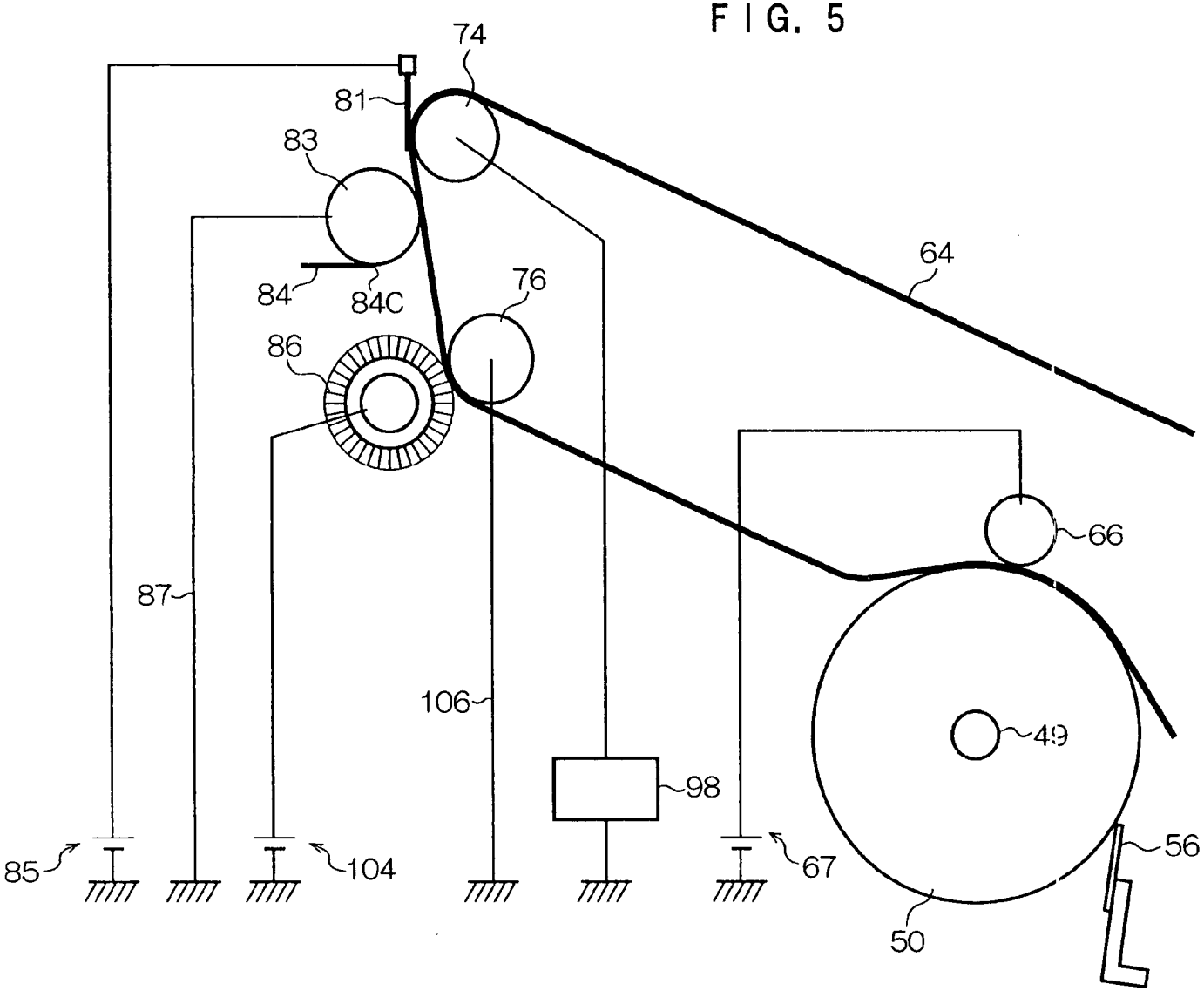
FIG. 5 is an explanatory diagram schematically illustrating a vicinity of the intermediate transfer belt cleaner of the intermediate transfer device of the embodiment of the present invention.

As shown in FIG. 5, a bias voltage source 85 is connected to the electrically-conductive sheet 81. A predetermined (e.g., 1700 V) bias voltage (or first bias voltage) is applied to the electrically-conductive sheet 81. When the electrically-conductive sheet 81 contacts the toner carrier surface 64H of the intermediate transfer belt 64, the toner on the toner carrier surface 64H is charged, and the amount of charge thereof is controlled. In the present embodiment, setting is carried out so as to apply a bias voltage of the opposite polarity as the toner (the imaging toner) used in the formation of the image on the toner carrier surface 64H.

The electrically-conductive sheet 81 has at least a width which is greater than or equal to the width of the toner image formed on the toner carrier surface 64H. The amount of charge of the toner can be reliably controlled as far as to the transfer direction end portions of the toner carrier surface 64H.

The cleaning roller 83 serving as a layer thinning mechanism is made of metal, and is formed in a solid-cylindrical or hollow-cylindrical shape. The cleaning roller 83 is rotated, by an unillustrated rotating driving source, at a peripheral speed which is substantially equivalent to the circulating speed of the intermediate transfer belt 64. The cleaning roller 83 is grounded (earthed) by an earthing wire 87, and the potential is maintained at 0 V. Accordingly, the outer peripheral surface (cleaning surface 83C) of the cleaning roller 83 electrostatically attracts the charge-controlled toner on the toner carrier surface 64H of the intermediate transfer belt 64, and removes (thins the layer of) the toner on the toner carrier surface 64H. The cleaning roller 83 also has at least a width which is greater than or equal to the width of the toner image formed on the toner carrier surface 64H, and can thin the layer of the toner reliably as far as to the transverse direction end portions of the toner carrier surface 64H.

In the present embodiment, the cleaning back-up roller 74 is grounded via a voltage maintaining element 98. Up until the potential of the cleaning back-up roller 74 reaches a predetermined value, the voltage maintaining element 98 stores charge therein, and contributes to the rise in the potential of the cleaning back-up roller 74. When the cleaning back-up roller 74 reaches the predetermined potential, the voltage maintaining element 98 releases the charge. In this way, the cleaning back-up roller 74 is stably maintained at a predetermined potential (e.g., 700 V). For example, a varistor, a Zener diode, or the like may be used as the voltage maintaining element 98 which carries out such a function.

Figure 6:
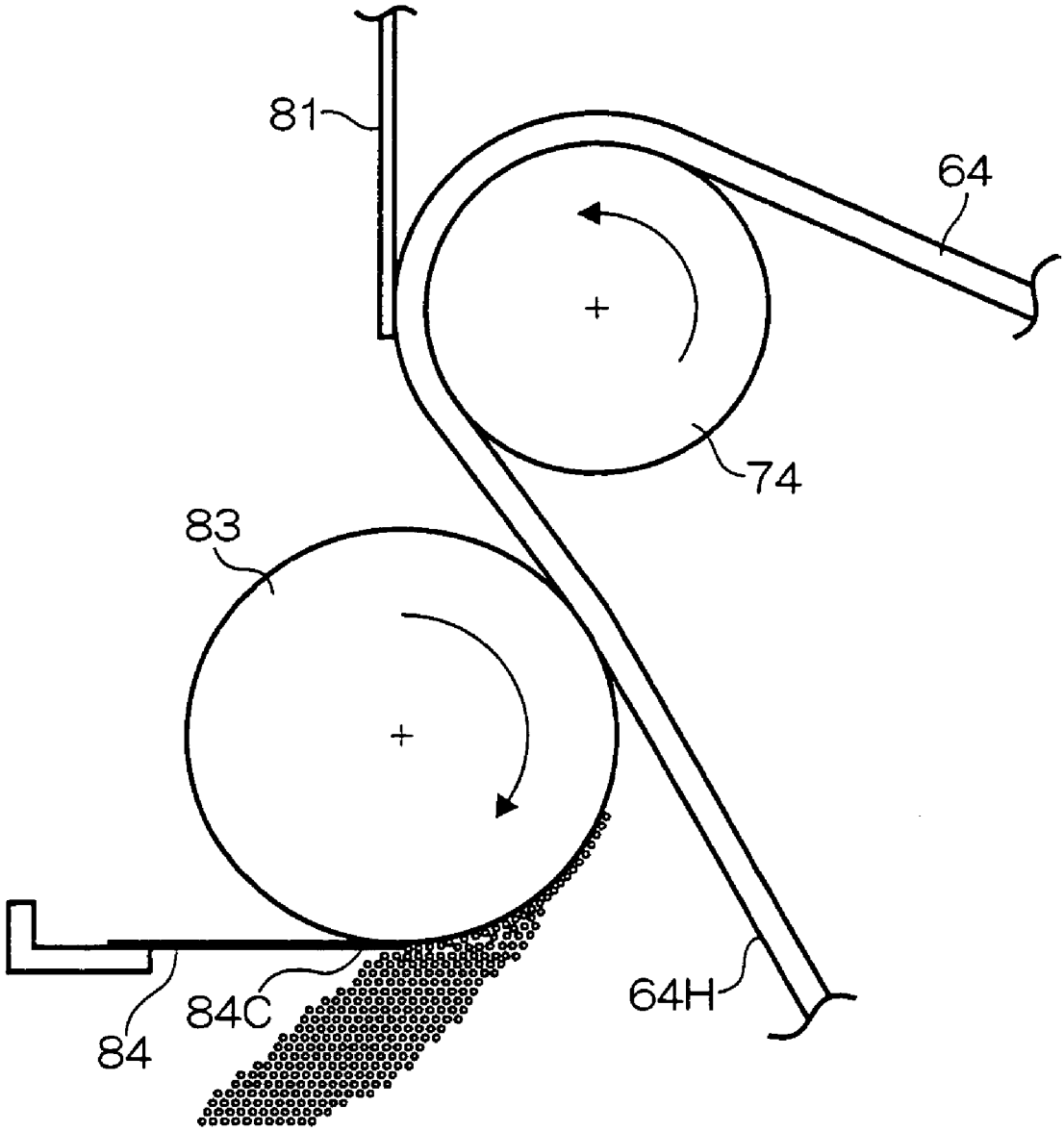
FIG. 6 is an explanatory diagram showing the cleaner for the intermediate transfer belt of the intermediate transfer device of the embodiment of the present invention, including the cleaning roller and a scraper.

As shown in FIG. 6, a scraper 84 is disposed so as to correspond to the cleaning roller 83. The scraper 84 is formed, for example, as a thin plate made of a metal such as stainless steel or the like. A cleaning portion 84C at the distal end of the scraper 84 is disposed so as to be directed in the direction opposite the direction of rotation of the cleaning roller 83, and so as to contact the outer peripheral surface of the cleaning roller 83. The scraper 84 scrapes off the waste toner which adheres to the outer peripheral surface of the cleaning roller 83, so as to clean the cleaning roller 83.

The brush roller 86 scrapes off the portion of the waste toner remaining after cleaning by the cleaning roller 83, and recharges the remaining toner. The toner recovery case 88 recovers the waste toner cleaned off by the cleaning roller 83 and the brush roller 86. As described above, in the present embodiment, the cleaning back-up roller 74 and the brush back-up roller 76 are disposed near to each other. Therefore, the single toner recovery case 88 can be provided in common for the cleaning roller 83 and the brush roller 86, and the intermediate transfer device 62 can be made compact for this reason as well.

The brush roller 86 is formed from a brush of acryl or the like which is subjected to electrically-conductive processing. While the intermediate transfer belt 64 is conveying the toner image, the cleaning roller 83 and the brush roller 86 are set apart from the intermediate transfer belt 64. At a predetermined timing, the cleaning roller 83 and the brush roller 86 abut the intermediate transfer belt 64 together. In the same way as the cleaning roller 83, the brush roller 86 also rotates at a peripheral speed which is substantially equivalent to the circulating speed of the intermediate transfer belt 64, by an unillustrated rotating driving source.

The brush roller 86 is connected to a second bias power source 104. The brush roller 86 serves as a second bias applying mechanism of the present invention. The brush back-up roller 76 serves as a second belt supporting mechanism in the present invention.

The polarity of the voltage (second bias voltage) applied from the brush roller 86 to the toner on the toner carrier surface 64H is the same polarity as that of the voltage (first bias voltage) applied to the toner from the electrically-conductive sheet 81. A predetermined potential difference is stably maintained also between the brush roller 86 and the brush back-up roller 76. In this way, the portion of the toner on the toner carrier surface 64H, which was not completely removed by the cleaning roller 83, is scraped off, and the remainder is again charged to the polarity opposite that of the imaging toner. This toner is again transferred to the photosensitive drum 50 so as to be removed from the toner carrier surface 64H.

The cleaning back-up roller 74 and the brush back-up roller 76 are insulated. The brush back-up roller 76 is grounded by an earthing wire 106. The potential of the brush back-up roller 76 is always maintained at 0 V.

The intermediate transfer device 62, the photosensitive drum 50, the charging roller 52, the cleaner 54 for the photosensitive drum, and the cleaner 82 for the intermediate transfer belt are integral, and structure a portion of an image forming unit 96.

The fusing device 90 is disposed above the secondary transfer position. The fusing device 90 has a heating roller 92 and a pressure-applying roller 94. The fusing device 90 fixes, to the recording sheet P, the toner image which is secondarily transferred to the recording sheet P by the secondary transfer roller 80 and the secondary transfer back-up roller 72, and conveys the recording sheet P toward the discharge rollers 34. The discharge rollers 34 discharge the recording sheet P out from the discharge opening 30 to the discharge section 36 provided at the top portion of the opening/closing cover 16.

Operation of the present embodiment will be described next.

When, at the time of image formation, the toner used in image formation (the imaging toner) does not exist on the toner carrier surface 64H of the intermediate transfer belt 64 (e.g., immediately after the circulating-driving of the intermediate transfer belt 64, or the like), the cleaner 82 for the intermediate transfer belt is at the contact position, and the electrically-conductive sheet 81, the cleaning roller 83, and the brush roller 86 abut the toner carrier surface 64H of the intermediate transfer belt 64.

Figure 3:
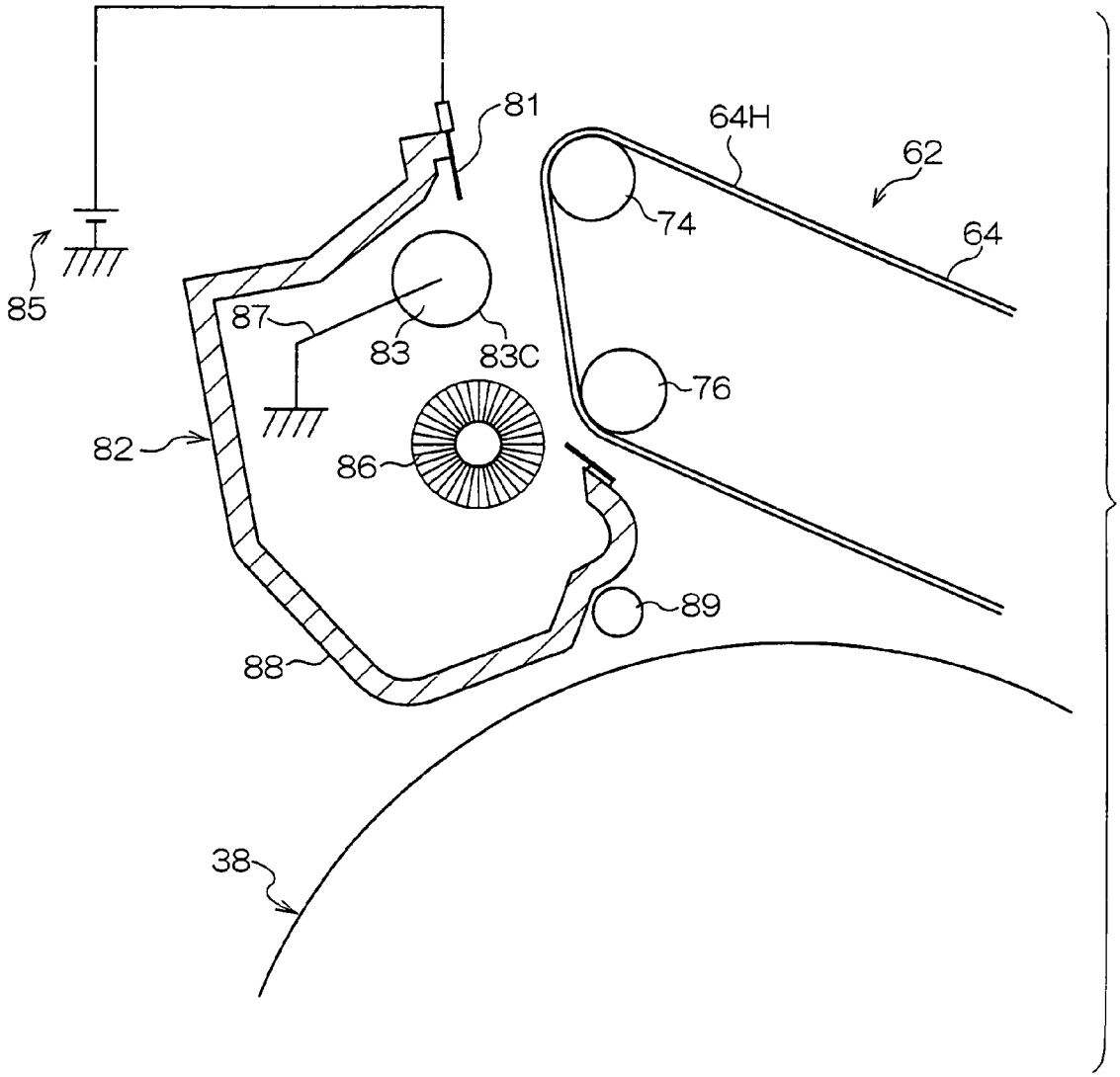
FIG. 3 is an enlarged sectional view showing a vicinity of the intermediate transfer belt cleaner of the intermediate transfer device of the embodiment of the present invention, at a position of being separated from the intermediate transfer belt.

In contrast, when, at the time of image formation, the imaging toner exists on the toner carrier surface 64H of the intermediate transfer belt 64, as shown in FIG. 3, the cleaner 82 for the intermediate transfer belt is at the separated position, and the electrically-conductive sheet 81, the cleaning roller 83, and the brush roller 86 are set apart from the toner carrier surface 64H of the intermediate transfer belt 64. In this way, the toner carrier surface 64H of the intermediate transfer belt 64 is cleaned reliably only at times when cleaning is needed. When cleaning is not necessary, the toner is not removed unnecessarily.

When an image formation signal is transmitted, driving force is transmitted to a driving gear of the photosensitive drum 50 by an unillustrated driving mechanism, such that the photosensitive drum 50 rotates.

The photosensitive drum 50 is charged uniformly by the charge roller 52. The light rays from the exposure device 60 are irradiated, on the basis of an image signal, onto the photosensitive drum 50 which is charged. The light rays from the exposure device 60 expose the surface of the photosensitive drum 50, such that latent images are formed. The latent images on the photosensitive drum 50 formed by the exposure device 60 are developed into toner images of yellow, magenta, cyan, and black by the rotary developing device 38, and the toner images are primarily transferred onto the intermediate transfer belt 64 in a superposed manner. In the primary transfer, the waste toner remaining on the photosensitive drum 50 is scraped off by the cleaner 54 for the photosensitive drum, and is recovered.

On the other hand, due to a sheet feed signal or the like, the recording sheet P accommodated in the sheet feed cassette 22 is fed out by the feed roller 24, is separated by the retard roller 26, and is led to the conveying path 28. The recording sheet P is temporarily stopped by the resist rollers 32, and then, at a given timing, is guided to between the secondary transfer roller 80 and the secondary transfer back-up roller 72. When the recording sheet P is guided to between the secondary transfer roller 80 and the secondary transfer back-up roller 72, the toner image, which was primarily transferred to the intermediate transfer belt 64, is secondarily transferred onto the recording sheet P by the secondary transfer roller 80 and the secondary transfer back-up roller 72.

The recording sheet P, to which the toner image is transferred, is guided to the fusing device 90 where the toner image is fixed by the heat and pressure of the heating roller 92. The recording sheet P, to which the toner image is fixed, is discharged out to the discharge section 36 from the discharge opening 30 by the discharge rollers 34.

After the secondary transfer, the waste toner remaining on the toner carrier surface 64H of the intermediate transfer belt 64 is removed and recovered by the cleaner 82 for the intermediate transfer belt. Namely, the waste toner on the toner carrier surface 64H is first charge-controlled to a predetermined amount of charge by the electrically-conductive sheet 81. The cleaning surface 83C of the cleaning roller 83 electrostatically attracts the charge-controlled toner on the toner carrier surface 64H of the intermediate transfer belt 64, and removes the toner from the toner carrier surface 64H so as to thin the layer of the remaining toner. At this time, because the cleaning roller 83 is rotating at a peripheral speed which is substantially equivalent to the circulating speed of the intermediate transfer belt 64, the force, in the circulating direction, which is applied from the cleaning roller 83 to the intermediate transfer belt 64 is small. The load applied to the intermediate transfer belt 64 which is elastic is small, and extension/contraction of the intermediate transfer belt 64 can be reduced.

In the present embodiment, the bias power source 85 is connected to the electrically-conductive sheet 81. The cleaning back-up roller 74, which is disposed so as to oppose the electrically-conductive sheet 81 via the intermediate transfer belt 64, is grounded via the voltage maintaining element 98. Moreover, the cleaning roller 83, which is downstream of the electrically-conductive sheet 81 and which opposes the cleaning back-up roller 74 via the intermediate transfer belt 64, is directly grounded. Accordingly, the cleaning back-up roller 74 acts as a common counter electrode to both the electrically-conductive sheet 81 and the cleaning roller 83, and is maintained at a predetermined potential.

Figure 7:
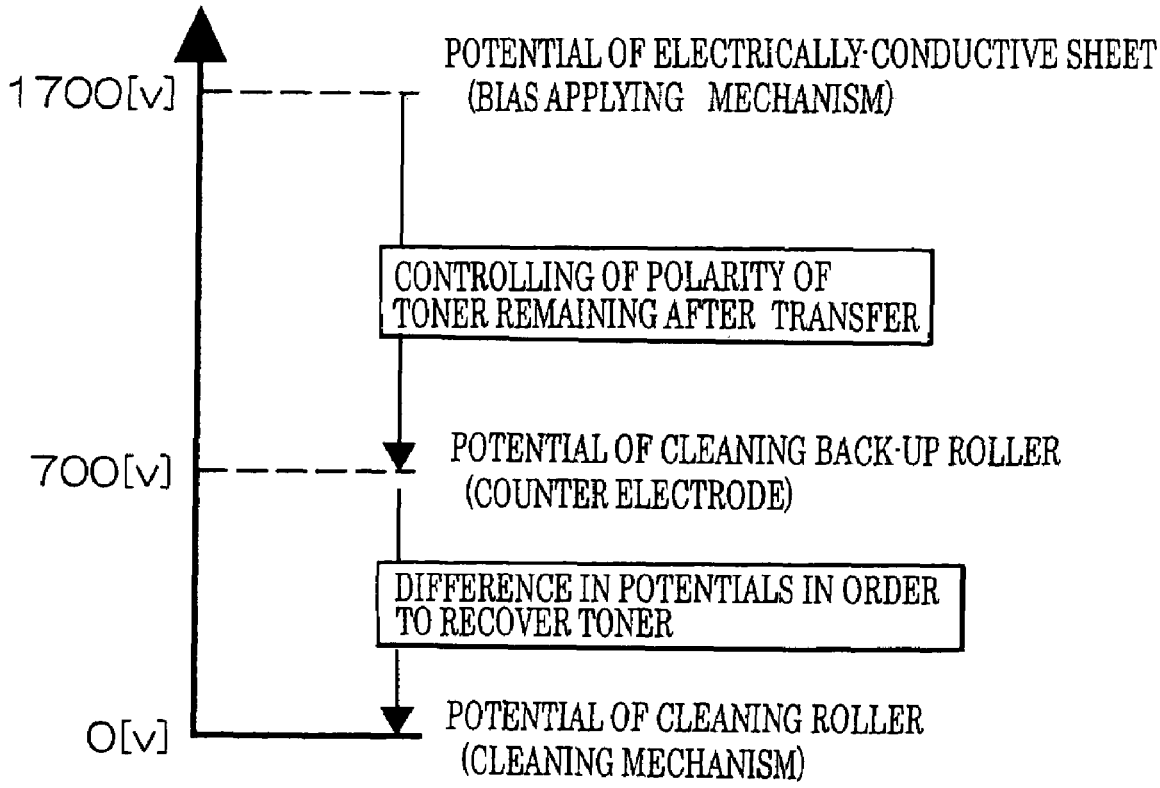
FIG. 7 is an explanatory diagram showing an electrically-conductive sheet, a cleaning back-up roller, and the cleaning roller at the cleaner for the intermediate transfer belt relating to the embodiment of the present invention.

As shown in FIG. 7, due to the difference in potentials (1 kV in the example of FIG. 7) between the electrically-conductive sheet 81 and the cleaning back-up roller 74, the toner remaining on the toner carrier surface 64H of the intermediate transfer belt 64 even after transfer is charged, and is controlled to a predetermined polarity. Further, due to difference in potentials (700 V in the example of FIG. 7) between the cleaning back-up roller 74 and the cleaning roller 83, the toner, which is on the toner carrier surface 64H and whose polarity is uniformized, is attracted and recovered by the cleaning roller 83, such that the layer of the toner is thinned. Note that the brush roller 86 can further scrape off the waste toner which remains after cleaning by the cleaning roller 83. The toner recovery case 88 recovers the waste toner which has been cleaned off by the cleaning roller 83 and the brush roller 86. At this time, a portion of the waste toner remains on the toner carrier surface 64H of the intermediate transfer belt 64.

The second bias voltage is applied by the brush roller 86 to the toner which remains on the toner carrier surface 64H, such that the toner is again charged to the same polarity as the charging by the electrically-conductive sheet 81. In this way, the remaining toner on the toner carrier surface 64H is again transferred to the photosensitive drum 50, and can be removed from the toner carrier surface 64H. The waste toner which adheres to the photosensitive drum 50 is scraped off by the cleaning blade 56, and is recovered in the toner recovery case 58.

In this way, in the present embodiment, the two cleaning members, which are the electrically-conductive sheet 81 and the cleaning roller 83 at the upstream side on the one hand, and the brush roller 86 at the downstream side on the other hand, are provided as the cleaning members for removing the toner on the toner carrier surface 64H of the intermediate transfer belt 64. Therefore, as compared with a structure in which only one cleaning member is provided, cleaning can be carried out reliably even if the contact pressure of the respective cleaning members with respect to the intermediate transfer belt 64 is low. Because the contact pressure can be made to be low, elongation of the intermediate transfer belt 64 can be kept small even if the intermediate transfer belt 64 is elastic.

In the present embodiment, the attracting of the waste toner on the toner carrier surface 64H is carried out not only by the cleaning roller 83, but also by using the photosensitive drum 50 as well. The toner is substantially attracted by two members (cleaning members). Accordingly, as compared with a structure in which the toner is attracted by only one cleaning member, cleaning can be reliably carried out even if the contact pressure of each cleaning member with respect to the intermediate transfer belt 64 is low.

Because the contact pressures applied to the intermediate transfer belt 64 from the cleaning members can be made to be low in the present embodiment, elongation of the intermediate transfer belt 64 can be kept small even if the intermediate transfer belt 64 is elastic.

Further, in the present embodiment, the toner on the toner carrier surface 64H of the intermediate transfer belt 64 is first removed at the cleaning roller 83, and the toner which could not be completely removed is removed at the photosensitive drum 50. Therefore, the majority of the waste toner on the toner carrier surface 64H is removed at the cleaning roller 83, and the amount of waste toner removed at the photosensitive drum 50 can be made to be small. In accordance with this difference in the amounts of recovered toner, the toner recovery case 58 is made to be more compact than the toner recovery case 88. Therefore, the intermediate transfer device 12 can be made more compact on the whole. In particular, more leeway can be given to the capacity of the toner recovery case 58 than the amount of waste toner estimated to be removed at the photosensitive drum 50. In this way, it is possible to delay the time for replacing the toner recovery case 58.

In the above description, an example is given of a structure in which the cleaning roller 83 is maintained at 0 V by being grounded. However, voltage of the same polarity as the polarity charged by the electrically-conductive sheet 81 may be applied to the cleaning roller 83. Namely, even with this structure, it suffices to generate, between the cleaning back-up roller 74 and the cleaning roller 83, a potential gradient of an extent that the toner charged by the electrically-conductive sheet 81 can be attracted by the cleaning roller 83.

In the above description, the polarity of the voltage (the second bias voltage) applied from the brush roller 86 to the toner on the toner carrier surface 64H is the same polarity as the voltage (the first bias voltage) applied from the electrically-conductive sheet 81 to the toner, and the toner on the toner carrier surface 64H, which was not completely removed at the cleaning roller 83, is again charged to the same polarity and is removed at the photosensitive drum 50. However, the polarity of the second bias voltage may be made to be the polarity opposite that of the first bias voltage applied from the electrically-conductive sheet 81 to the toner, and the toner on the toner carrier surface 64H, which is not completely removed at the cleaning roller 83, may be again attracted at the brush roller 86 and removed from the toner carrier surface 64H.

Figure 8:
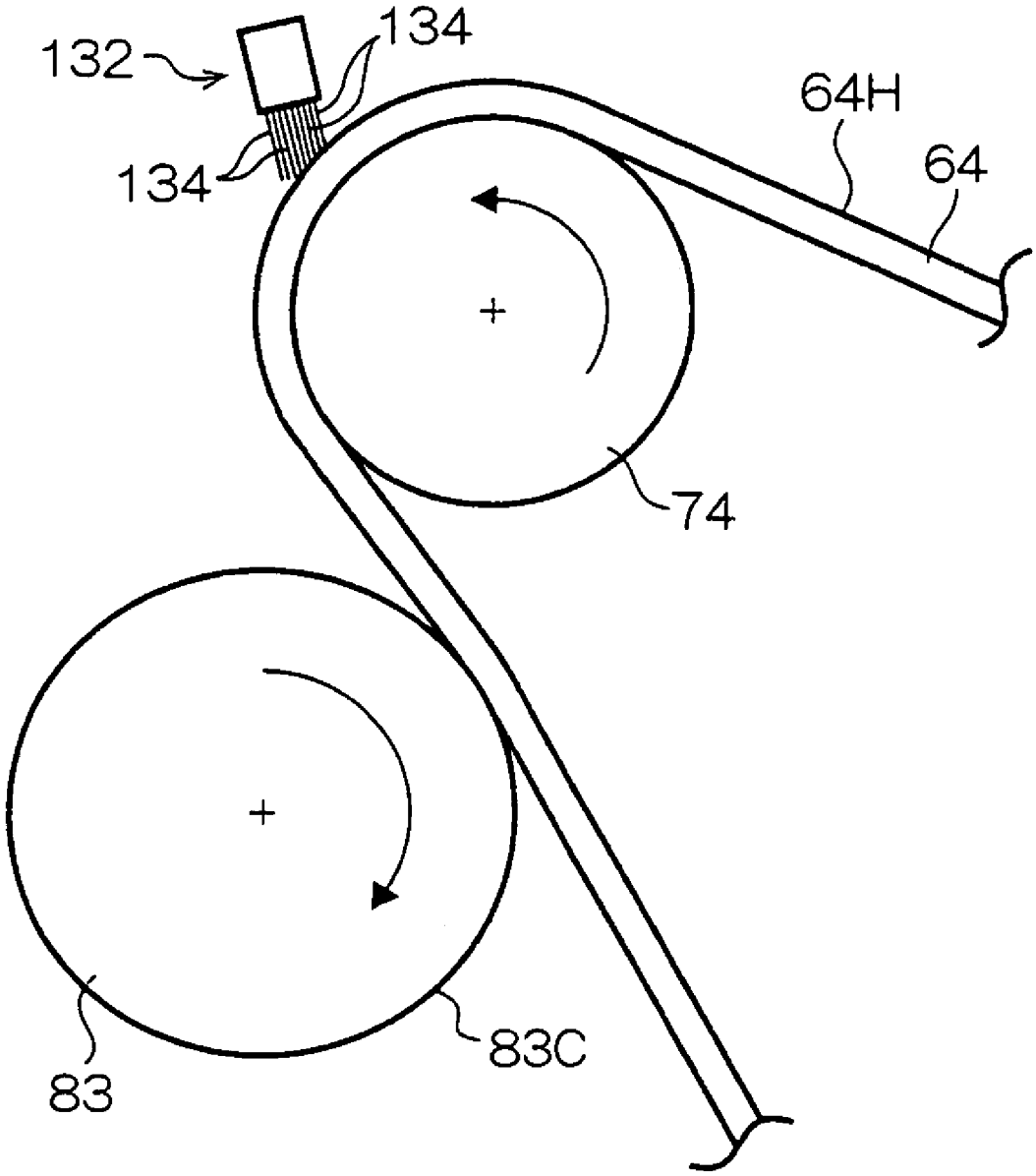
FIG. 8 is an explanatory diagram showing an example in which an electrically-conductive brush is used as a bias applying mechanism relating to the embodiment of the present invention.

The electrically-conductive sheet 81 is used as an example of the bias applying mechanism of the present invention in the above description. However, the structure of the bias applying mechanism is not particularly limited provided that the toner on the toner carrier surface 64H of the intermediate transfer belt 64 can be stably charge-controlled to a predetermined potential. For example, an electrically-conductive brush 132 shown in FIG. 8 may be used, and the distal ends of bristles 134 of the electrically-conductive brush 132 may contact the intermediate transfer belt 64 along the direction of circulating of the intermediate transfer belt 64. When the electrically-conductive brush 132 is used, because the distal ends of the large number of bristles 134 contact the toner carrier surface 64H, the toner can be charged more uniformly.

Figure 9:
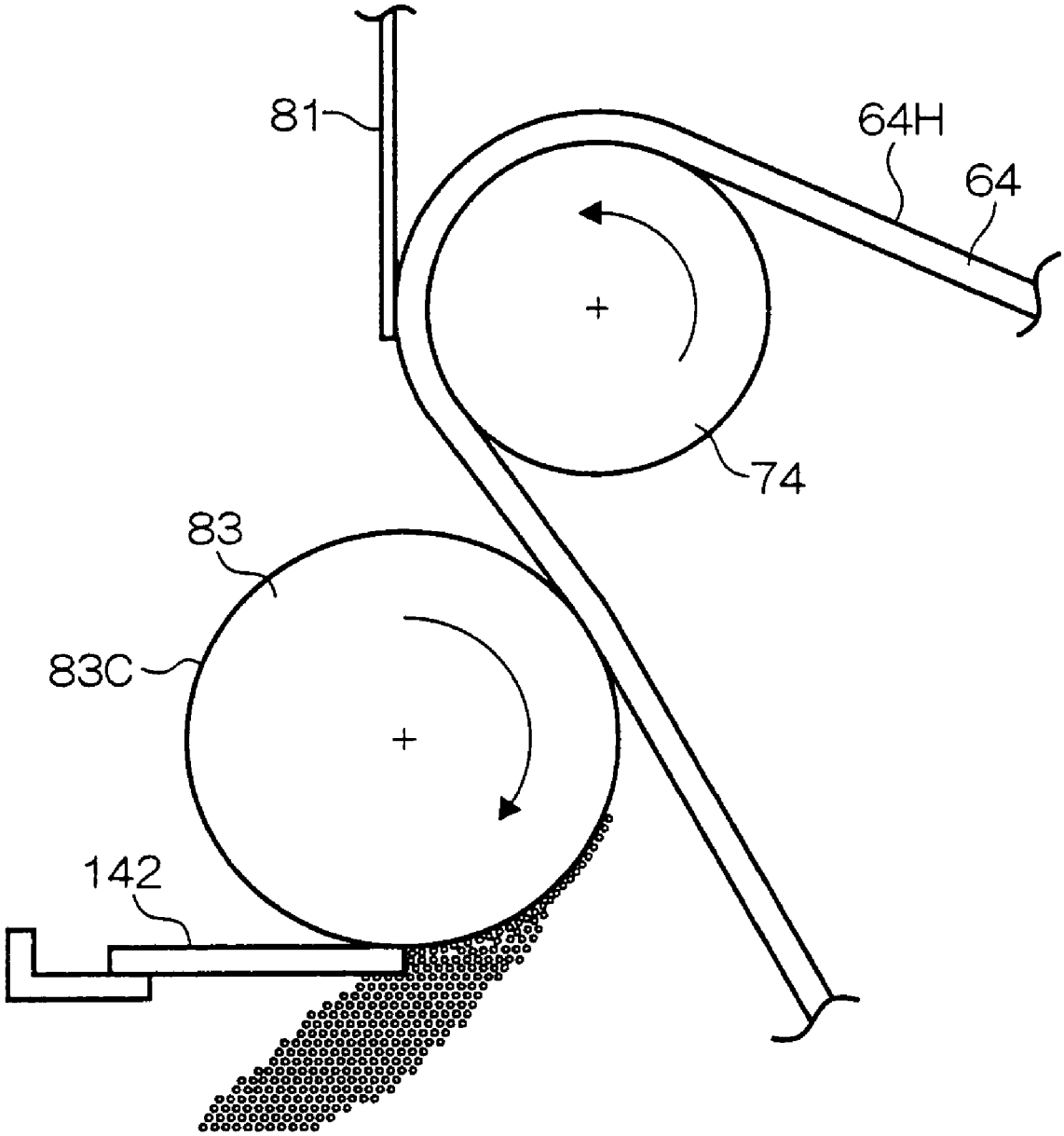
FIG. 9 is an explanatory diagram showing an example in which a urethane blade is used as a toner scraping member relating to the embodiment of the present invention.
Figure 10:
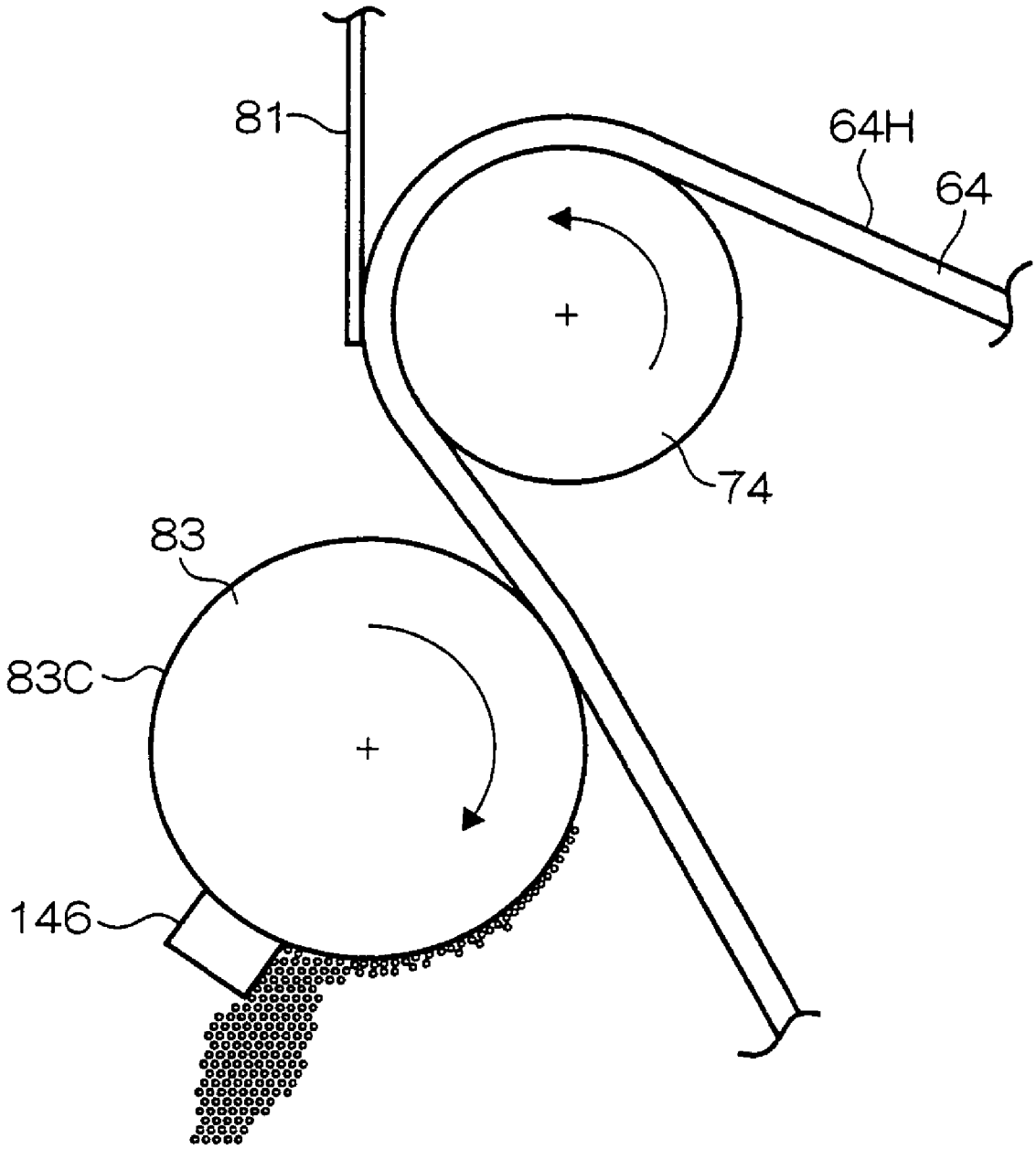
FIG. 10 is an explanatory diagram showing an example in which a pad is used as the toner scraping member relating to the embodiment of the present invention.

Similarly, the structure (material and configuration) of the toner scraping member of the present invention is not limited provided that it can reliably remove toner from the outer peripheral surface of the cleaning roller 83. A plate shaped member formed of resin, such as, for example, a urethane blade 142 shown in FIG. 9 or the like, may be used, and, in the same way as the scraper 84, may be disposed such that the distal end thereof contacts the outer peripheral surface of the cleaning roller 83 while being directed in the direction opposite to the direction of rotation of the cleaning roller 83. Moreover, as shown in FIG. 10, a structure may be used in which a pad 146 is pushed against the outer peripheral surface of the cleaning roller 83, and scrapes off the toner on the outer peripheral surface of the cleaning roller 83.

The medium on which the image is formed by the color printer 10 of the present invention is not limited to the recording sheet P, and may be, for example, an OHP sheet.

Because the present invention is structured as described above, toner remaining after transfer can be reliably removed while mechanical stresses on the intermediate transfer belt are lessened and elongation of the belt is kept small.

In the embodiment of the present invention, the positions of the plural cleaning members are not limited provided that the cleaning members can clean the intermediate transfer belt. For example, when a limiting mechanism (e.g., an electrode or the like) which limits the amount of flexure of the intermediate transfer belt from the reverse surface side of the cleaning position by the cleaning member is provided, the intermediate transfer belt is not flexed excessively at the time of cleaning, and the amount of flexure thereof can be limited. Moreover, when the cleaning members are disposed so as to oppose the belt supporting mechanisms across the intermediate transfer belt, the belt supporting mechanisms can also function as the aforementioned limiting mechanism.

By providing the plural belt supporting mechanisms near to one another, the intermediate transfer device can, on the whole, be made to be compact. Generally, a member which accommodates the toner removed by the cleaning member is provided. By using a removed toner accommodating member which is common to plural cleaning members, the intermediate transfer device can be made even more compact.

In accordance with the embodiment of the present invention, as compared to a structure in which, for example, the toner on the toner carrier surface is removed by scraping, the force applied to the intermediate transfer belt can be made to be smaller, and elongation of the intermediate transfer belt can be reduced.

Further, the number of parts is reduced, and the intermediate transfer device can be made compact.

In accordance with the embodiment of the present invention, as compared with a structure in which the first bias applying mechanism contacts the intermediate transfer belt along the direction opposite to the direction of circulating of the intermediate transfer belt, there is less catching of the intermediate transfer belt on the first bias applying mechanism, elongation of the intermediate transfer belt can be reduced even more, and damage to the belt can be prevented.

In addition, the toner on the toner carrier surface can be efficiently attracted by the layer thinning mechanism.

The toner, whose layer has been thinned by the layer thinning mechanism, can be sufficiently charged by the second bias applying mechanism. Therefore, it is possible to prevent the toner, which is supplied for image formation on the toner carrier surface (the imaging toner), from affecting the image, and so-called voids and ghosting from arising.

The toner, whose charge is controlled at the first bias applying mechanism, can be reliably attracted.

In accordance with the embodiment of the present invention, the rotary-type layer thinning mechanism rotates at an equivalent speed along the direction of circulating of the intermediate transfer belt. The force, in the direction of circulating, which is applied to the intermediate transfer belt from the rotary-type layer thinning mechanism can thereby be made to be small, and therefore, extension/contraction of the intermediate transfer belt can be reduced.

Further, the layer thinning mechanism can be refreshed, so that the ability thereof to attract toner can be maintained.

The toner on the toner carrier surface can be efficiently attracted at the image carrier.

In accordance with the embodiment of the present invention, the rotary-type bias applying mechanism rotates at an equivalent speed along the direction of circulating of the intermediate transfer belt. The force, in the direction of circulating, which is applied to the intermediate transfer belt from the rotary-type bias applying mechanism can thereby be made to be small, and therefore, extension/contraction of the intermediate transfer belt can be reduced.

The unneeded toner at the transverse direction end portions of the intermediate transfer belt can be reliably removed without remaining thereat.

As compared with a structure in which the amount of toner removed from the intermediate transfer belt by the layer thinning mechanism is less than (or about the same as) the amount of toner removed by the toner removing mechanism, the time at which the second waste toner accommodating member becomes full can be delayed. The first waste toner accommodating member can be replaced independently of the second waste toner accommodating member.

Further, by making the second waste toner accommodating member compact, the intermediate transfer device can, on the whole, also be made compact.

What is claimed is:

1. An intermediate transferring device comprising:

an intermediate transfer belt formed in an endless shape, and supported by a plurality of belt supporting mechanisms so as to be able to circulate, and having elasticity at least in a direction of circulation;

a layer thinning mechanism contacting a toner carrier surface of the intermediate transfer belt, and electrostatically attracting toner which is on the toner carrier surface so as to thin a layer of the toner;

a bias applying mechanism provided at a downstream side, in the direction of circulation of the intermediate transfer belt, of the layer thinning mechanism, and applying a bias voltage to the toner on the toner carrier surface whose layer has been thinned;

an image carrier provided at a downstream side, in the direction of circulation of the intermediate transfer belt, of the bias applying mechanism, and carrying a visible image to be transferred onto the toner carrier surface, the toner on the toner carrier surface, to which the bias voltage has been applied by the bias applying mechanism, being transferred onto the image carrier;

a toner removing mechanism removing the toner on the image carrier; and a first waste toner accommodating member accommodating toner which has been removed from the intermediate transfer belt by the layer thinning mechanism;

a second waste toner accommodating member accommodating toner which has been removed from the image carrier by the toner removing mechanism; and a second waste toner accommodating member accommodating toner which has been removed from the image carrier by the toner removing mechanism; and wherein an amount of toner removed from the intermediate transfer belt by the layer thinning mechanism is greater than an amount of toner removed by the toner removing mechanism.

2. An image forming device comprising:

the intermediate transfer device of claim 1 a primary transfer section primarily transferring a toner image to the intermediate transfer device; and a secondary transfer section secondarily transferring the toner image of the intermediate transfer device onto a recording medium.

3. An intermediate transfer device comprising:

an intermediate transfer belt formed in an endless shape, and supported by a plurality of belt supporting mechanisms so as to be able to circulate, and having elasticity at least in a direction of circulating;

a first bias applying mechanism applying a first bias voltage to toner on a toner carrier surface of the intermediate transfer belt, so as to control a first amount of charge of the toner;

a layer thinning mechanism provided at a downstream side, in the direction of circulation of the intermediate transfer belt, of the first bias applying mechanism, and contacting the toner carrier surface and electrostatically attracting the toner which is on the toner carrier surface so as to thin a layer of the toner, wherein the layer thinning mechanism is arranged to contact the toner carrier surface so that the rear surface of the intermediate transfer belt at the contact position does not contact the belt supporting mechanisms;

a second bias applying mechanism provided at a downstream side, in the direction of circulation of the intermediate transfer belt, of the layer thinning mechanism, and applying a second bias voltage to the toner whose layer has been thinned, so as to control a second amount of charge of the toner;

an image carrier provided at a downstream side, in the direction of circulation of the intermediate transfer belt, of the second bias applying mechanism, and carrying a visible image to be transferred onto the toner carrier surface, the toner on the toner carrier surface, to which the second bias voltage has been applied, being transferred onto the image carrier;

a toner removing mechanism removing the toner on the image carrier; and a first waste toner accommodating member accommodating toner which has been removed from the intermediate transfer belt by the layer thinning mechanisnn; and a second waste toner accommodating member accommodating toner which has been removed from the image carrier by the toner removing mechanism;

wherein an amount of toner removed from the intermediate transfer belt by the layer thinning mechanism is greater than an amount of toner removed by the toner removing mechanism.

4. The intermediate transfer device of claim 3, wherein the second bias voltage has a polarity opposite to the polarity of toner supplied for image formation on the toner carrier surface of the intermediate transfer belt.

5. The intermediate transfer device of claim 3, wherein the second bias applying mechanism is a rotary-type bias applying mechanism which can rotate at substantially an equivalent speed along the direction of circulation of the intermediate transfer belt.

6. The intermediate transfer device of claim 3, wherein at least one of the first bias applying mechanism and the second bias applying mechanism has a width which is greater than a width of a toner image formed on the toner carrier surface of the intermediate transfer belt.

7. The intermediate transfer device of claim 3, wherein the first waste toner accommodating member has a larger capacity than the second waste toner accommodating member.

8. An image forming device comprising:

the intermediate transfer device of claim 3 a primary transfer section primarily transferring a toner image to the intermediate transfer device; and a secondary transfer section secondarily transferring the toner image of the intermediate transfer device onto a recording medium.

9. The intermediate transfer device of claim 3, wherein a counter electrode of the first bias applying mechanism and the layer thinning mechanism is provided in common.

10. The intermediate transfer device of claim 3, wherein the first bias applying mechanism is disposed so as to contact the intermediate transfer belt along a same direction as the direction of circulation of the intermediate transfer belt.

11. The intermediate transfer device of claim 3, wherein the first bias voltage has a polarity opposite to the polarity of toner supplied for image formation on the toner carrier surface of the intermediate transfer belt.

12. The intermediate transfer device of claim 3, wherein the layer thinning mechanism is grounded, or voltage of a same polarity as the polarity of toner supplied for image formation on the toner carrier surface of the intermediate transfer belt is applied to the layer thinning mechanism.

13. The intermediate transfer device of claim 3, wherein the layer thinning mechanism is a rotary-type layer thinning mechanism which can rotate at substantially an equivalent speed along the direction of circulation of the intermediate transfer belt.

14. The intermediate transfer device of claim 3, further comprising a second toner removing mechanism removing toner adhering to the layer thinning mechanism.

* * * * *